US010320122B2

(12) United States Patent
Bozikis

(10) Patent No.: US 10,320,122 B2
(45) Date of Patent: Jun. 11, 2019

(54) DOUBLE SIDE ADJUSTABLE ELECTRICAL CORD SECUREMENT DEVICE

(71) Applicant: Vaios Nikolaos Bozikis, Moraga, CA (US)

(72) Inventor: Vaios Nikolaos Bozikis, Moraga, CA (US)

( * ) Notice: Subject to any disclaimer, the term of this patent is extended or adjusted under 35 U.S.C. 154(b) by 0 days.

(21) Appl. No.: 15/818,763

(22) Filed: Nov. 21, 2017

(65) Prior Publication Data

US 2018/0316137 A1 Nov. 1, 2018

Related U.S. Application Data

(60) Provisional application No. 62/463,625, filed on Feb. 25, 2017.

(51) Int. Cl.
*H01R 13/639* (2006.01)

(52) U.S. Cl.
CPC ..... *H01R 13/639* (2013.01); *H01R 13/6392* (2013.01)

(58) Field of Classification Search
CPC ..... H01R 13/6392; H01R 13/639
USPC ..... 439/369–371
See application file for complete search history.

(56) References Cited

U.S. PATENT DOCUMENTS 2,903,669 A * 9/1959 Gilman ..... H01R 13/6392 174/135
3,014,194 A 12/1961 Berglund
3,029,408 A * 4/1962 Anderson ..... H01R 13/6392 439/369
3,985,415 A 10/1976 Wolpert
4,085,991 A 4/1978 Marshal
4,143,934 A 3/1979 Siebert
4,643,505 A 2/1987 House et al.
4,784,612 A * 11/1988 Ryan ..... H01R 13/639 439/367
4,925,396 A 5/1990 Grover
4,954,097 A 9/1990 Sekiguchi
5,104,335 A * 4/1992 Conley ..... H01R 13/6392 439/369
5,129,839 A 7/1992 VanSkiver
5,133,671 A * 7/1992 Boghosian ..... G09F 3/037 24/16 PB
5,135,409 A 8/1992 Thompson
5,154,626 A 10/1992 Watson
5,393,243 A 2/1995 Carmo
5,505,634 A * 4/1996 Osten ..... H01R 13/6392 439/367
5,507,664 A 4/1996 Carmo
5,573,420 A 11/1996 Grosswendt
5,584,720 A * 12/1996 Elswick ..... H01R 13/6392 439/368

(Continued)

*Primary Examiner* — Ross N Gushi
(74) *Attorney, Agent, or Firm* — S. Elizabeth Miller

(57) ABSTRACT

A system for securing an electrical connection is provided comprising a first half having a cord end and an open end and a second half, having a cord end and an open end. The cord ends of the first and second half each include a cord opening allowing a first and second cord to pass through the opening while holding a first and second electrical connector attached to each cord, and with the connectors engaged, the open ends include a means for securely attaching to each other thereby preventing disconnect of the engaged connectors.

11 Claims, 5 Drawing Sheets

(56) References Cited

U.S. PATENT DOCUMENTS

| | | | | |
|---|---|---|---|---|
| 5,772,462 | A * | 6/1998 | Osten | H01R 13/6392 439/367 |
| 5,820,398 | A | 10/1998 | Stabroth et al. | |
| 5,830,000 | A | 11/1998 | Shifflett et al. | |
| 6,056,557 | A | 5/2000 | Crotzer et al. | |
| 6,080,004 | A | 6/2000 | Kovacik et al. | |
| 7,001,202 | B2 * | 2/2006 | Robbins | H01R 13/625 439/367 |
| 7,347,708 | B1 | 3/2008 | Huang | |
| 7,407,405 | B1 * | 8/2008 | Slenczka | H01R 13/6392 439/369 |
| 8,197,278 | B2 * | 6/2012 | Reusche | H01R 13/6392 439/320 |
| 8,215,977 | B2 | 7/2012 | Zapf | |
| 8,287,292 | B2 | 10/2012 | Byrne | |
| 9,077,111 | B2 * | 7/2015 | Brown | H01R 13/6392 |
| 9,276,359 | B2 * | 3/2016 | Brown | H01R 13/6392 |
| 9,583,878 | B2 | 2/2017 | Bozikis | |
| 2016/0036164 | A1 | 2/2016 | Bozikis | |
| 2017/0170603 | A1 | 6/2017 | Bozikis | |

* cited by examiner

DOUBLE SIDE ADJUSTABLE ELECTRICAL CORD SECUREMENT DEVICE

CROSS-REFERENCE TO RELATED DOCUMENTS

The present application claims benefit of U.S. Provisional Patent Application No. 62/463,625 filed on Feb. 25, 2017.

BACKGROUND OF THE INVENTION

1. Field of the Invention

The present invention is in the field of hardware including casings and mechanisms for securing two components together and pertains particularly to methods and apparatus for securing two conjoining electric cord plug connectors together to preempt unintended disconnection.

2. Discussion of the State of the Art

In the field of electric devices and power cords there are many devices such as electric mowers, weed whackers, brush saws, masonry saws, power drills, etc. that require electrical connections in order to power the devices. The devices require power from an electrical outlet by way of an electrical power cord, either directly or via an extension power cord. Said power cords may include one of a variety of known electrical connectors. One example of connector is a typical two or three pronged plug connector (male) which may be attached by a power cord to a device requiring power. A power cord is used to connect the male connector on the device to a power source outlet. In some cases, where the device must be used further away from an outlet an extension power cord may be required to extend the power cord over a greater distance.

An extension cord consists of a female electrical receptacle connector and a male pronged connecter, connected by an electrical cable of a specific length. A male connector and a female connector may be conjoined creating a secure engaged connection. It is important both for efficiency and safety that the engaged connection remains connected; however, too often male to female connections may be accidentally disconnected, immediately cutting power from a device being used. An accidental disconnection potentially leads to wasted time in productivity, or possibly an injury for an operator using a high powered tool, for example a drill or chain saw.

Therefore, what is clearly needed is a plug connection securing device that may be adjusted to the size of any connectors being used, and that may be easily installed onto the power cords and connectors by a user.

BRIEF SUMMARY OF THE INVENTION

The present invention provides various embodiments for securing an electrical connection. One embodiment includes a first half having a cord end and an open end, and a second half having a cord end and an open end. The cord ends of the first and second half each may include a cord opening allowing a first and second cord, respectively, to pass through the opening while holding a first and second (male/female) electrical connector, each attached to a cord, and with the connectors engaged, the open ends include a means for securely attaching to each other thereby preventing disconnect of the engaged connectors.

Any embodiment described herein may be adapted wherein the cord ends of the first and second half each may include one or more cord openings allowing one or more first cords and one or more second cords to secure to pass through the one or more openings, while holding one or more first electrical connectors and one or more second electrical connectors, each attached to a cord, and with the one or connectors engaged, respectively, the open ends include a means for securely attaching to each other thereby preventing disconnect of the engaged connectors.

The means for securely attaching in any embodiment described herein may include at least one tooth on an extension arm on the first half, the arm extending through an arm opening to a tab on the second half positioned to engage the at least one tooth. Embodiments may also include multiple teeth positioned in a linear array on the arm, thereby enabling the tab to engage any one of the teeth thereby accommodating connectors of varying sizes.

One embodiment may include that each of the first and second halves include an arm with a tooth array on one side of each of the open ends and the arm opening with a tab on an opposing side of each of the open ends, thereby equalizing any force urging the connectors apart when the tabs are engaged with one of the multiple teeth. In any of the above embodiments, the first half and the second half may be identical.

In another embodiment, the cord end and the open end of each of the halves form a cylindrical shape. In this embodiment, instead of the securing means including the arm with tooth array, threads are provided on an inside surface near an open end of one half and matching threads on the second half enabling the threads to engage and hold the two halves together. In this embodiment, the distance between the two halves may be adjusted by the amount of turns made on the threads holding the two halves together.

Additionally, the cylindrical shaped area may include a slot connecting the open end and the cord opening, the cord opening and the slot having a diameter less than a width of the connectors.

A method of using the devices may be accomplished by providing the steps of providing a first half including a cord end and an open end, an arm opening in one position on the open end, then providing a second half including an arm extending away from the cord end, including at least one tooth. The arm then inserts through an arm opening on a second half having a fixed tab that engages the tooth, thus preventing the arm from withdrawing thereby holding the first and second halves together, and the engaged connectors.

Adjusting the distance between the two connected halves may be done by providing multiple teeth positioned in a linear array on the arm, thereby enabling the tab to engage any one of the teeth thereby accommodating connectors of varying sizes. In order to provide further stability between the connected halves, the first and second halves may both include the arm with tooth array on one side of each of the open ends and the arm opening with the tab on an opposing side of each of the open ends, thereby equalizing any force urging the connectors apart when the tabs are engaged with one of the multiple teeth.

In some embodiments of the method, the first half and the second half are identical. Additionally, the cord end and the open end of each of the halves may form a cylindrical shape, in most embodiments, but may also be a square or rectangular shape.

An additional embodiment specifically provides a first cylindrical half having a cord end and an open end and first threads on an inside surface of the open end, a second half, having a cord end and an open end including second threads on an outside surface of the open end, the threads mated with the first threads. This embodiment also may include that the cord ends of the first and second half each include a cord opening allowing a first and second cord to pass through the opening while holding a first and second electrical connector attached to each cord, and with the connectors engaged, the open ends may rotate in opposite directions in order to engage the first and second threads thereby preventing disconnect of the engaged connectors. In this embodiment substantial forces may be applied against the connected open ends while the threaded connection holds the engaged connectors in place.

This embodiment also provides that the cylindrical halves include a slot connecting the open end and the cord opening, the cord opening and the slot having a diameter less than a width of the connectors.

DETAILED DESCRIPTION OF THE INVENTION

Figure 1A:
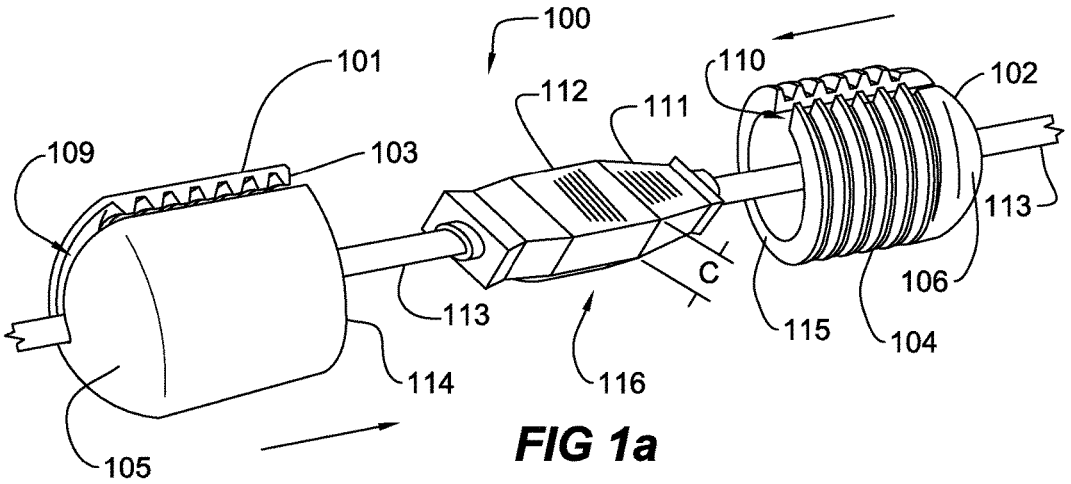
FIG. 1*a* is a perspective view of one embodiment of the electrical cord securement device.

FIG. 1*a* illustrates an embodiment of an electrical cord securement device 100. The device is composed of an outer hollow cylindrical casing 101 and an inner hollow cylindrical casing 102. Outer casing 101 is manufactured with female helical right-hand coarse threads 103 on the inner surface of a cylindrical portion of the casing. Casing 101 has a hollow hemispherical closed end 105 at distal end of casing, and is open at its mating end 114 of the casing. Outer casing 101 has a slotted opening 109 which runs parallel to a centerline along the length of the casing from open end 114 to a center point of end 105.

As indicated in FIG. 1*a*, inner casing 102 is manufactured with male coarse threads 104 mating to threads 103. Similar to outer casing 101, inner casing 102 also has a hollow hemispherical closed end 106 at the distal end, and an open mating end 115. Inner casing 102 has a slotted opening 110 which runs parallel to the centerline of the casing and along length of the casing from end 115 to a center point of end 106. FIG. 1*a* shows an engaged connection 116 consisting of a male connector 111 mated to a female connector 112 and an electrical cord 113 which may be cradled in slotted opening 109. A dimension C indicates the narrowest cross-sectional dimension of engaged connection 116.

Figure 1B:
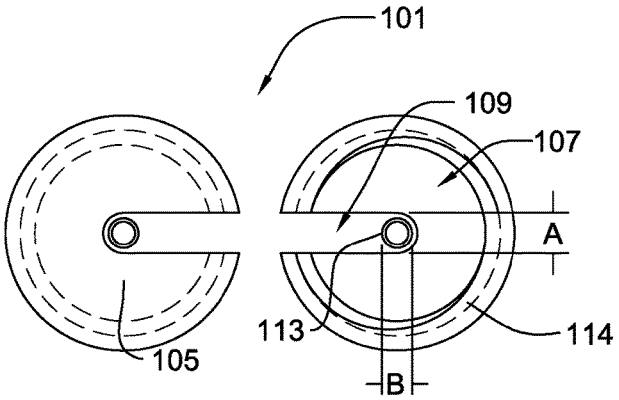
FIG. 1*b* provides end views of the outer cylindrical casing.

FIG. 1*b* provides end views of outer casing 101 having end 105 and mating end 114 allowing access to hollow interior 107 of casing 101. FIG. 1*b* shows electrical cords 113 cradled in slotted opening 109 in casing 101 parallel to its centerline as shown. The view showing the distal end 105 of the casing also indicates a width A of slotted opening 109 extending to a semicircular end of the slotted opening and a diameter B of cord 113. Dimension A is greater than dimension B of cord 113 but is less than dimension C. The width of slot opening 109 allows cord 113 of lesser diameter to slide into place but the opening is narrow enough that the wider engaged connection 116 will be safely constrained inside the mated casings.

Figure 1C:
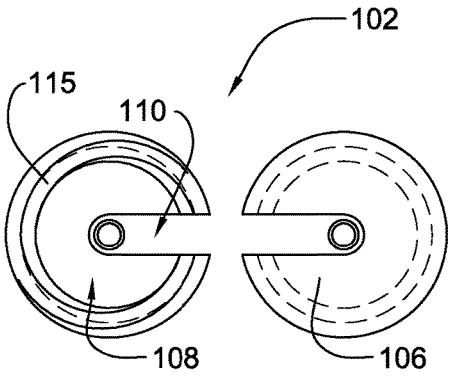
FIG. 1*c* provides end views of the inner cylindrical casing.

FIG. 1*c* provides and end view of inner casing 102 having an open mating end 115 allowing access to a hollow interior 108 of inner casing and an end view of closed end 106. The hollow area 108 inside the inner casing may be of any size when casings 101 and 102 are conjoined that can accommodate the engaged connection 116, for example 1½ inches or greater in diameter, and 2 inches to 6 inches deep.

The casings may be constructed of any sturdy moldable material, for example polymers including durable UV-resistant plastic with some flexibility to reduce potential for breakage. In one embodiment coarse threads are incorporated in lieu of finer threads to facilitate rotating together by the user without cross threading, to advance the movement of the casing elements together with less effort, and to reduce the potential for grit to cause the threads to bind.

FIG. 1*a* illustrates that to use this device connectors 111 and 112 are engaged and electrical cord 113 is fitted into slotted openings 109 and 110 in each casing 101 and 102 respectively. The user moves casings 101 and 102 linearly along extension cords 113 as indicated by directional arrows in FIG. 1*a* until the casings meet, encompassing engaged connection 116 within the hollow body of the casings.

Figure 1D:
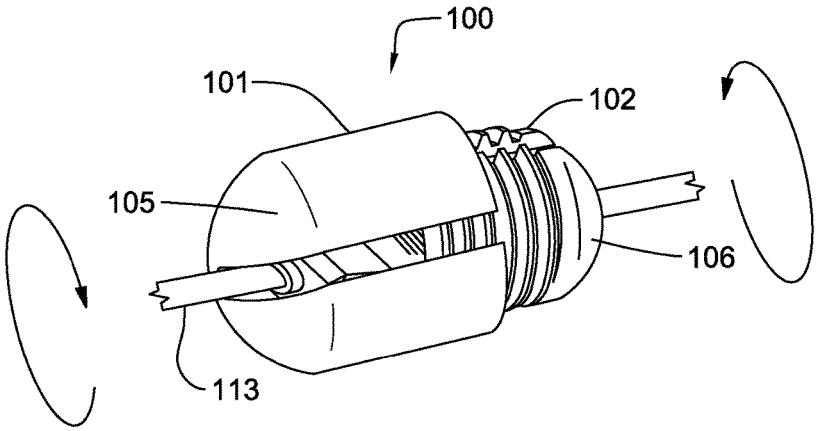
FIG. 1*d* is a perspective view of the cylindrical casings aligned encompassing and securing the engaged cord connection.

FIG. 1*d* indicates, as casing elements 101 and 102 align, the user rotates one or both of the casings, in opposing normal right-hand thread directions as indicated by the rotational arrows, thus engaging threads 103 and 104 together. Rotating as indicated advances threaded casing elements 101 and 102 along their common centerline and that of electrical cords 113 and the overall length of the conjoined casings is reduced bringing hollow hemispherical ends 105 and 106 closer together they come in contact with engaged connection 116 within. When casing ends 105 and 106 are both in contact with engaged connection 116 and casings are rotated hand-tight engaged connection 116 is held securely and protected from unintentional disconnection.

When use of the cord securement device is no longer required, the user will rotate one or both of the casing elements in opposing left-hand direction until they are no longer conjoined. Cord connectors 111 and 112 may then be disengaged. When no longer in use, casings may be rotated together conjoining them over one of the extension cord connectors for convenient storage and safe keeping.

Figure 2A:
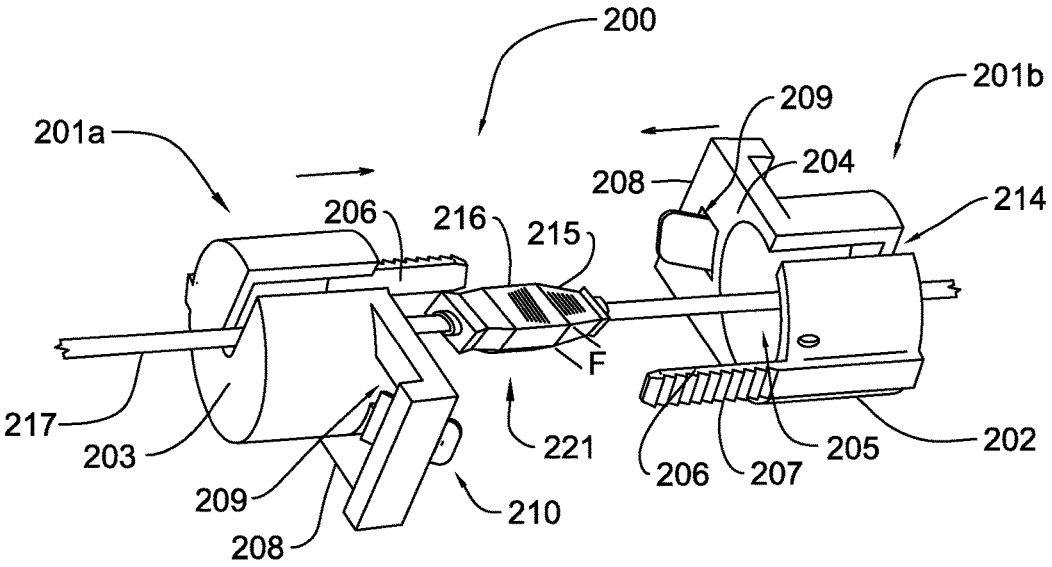
FIG. 2*a* is a perspective view of another embodiment of the electrical cord securement device.

FIG. 2*a* depicts another embodiment of an electrical cord securement device. Securing device 200 is composed of two identical casing elements 201*a* and 201*b*. As casing elements 201*a* and 201*b* are identical element numbers and witness lines are not repeated on both 201*a* and 201*b*. Casing element 201*a* has a hollow cylindrical body 202 with a closed surface 203 at the distal end and an open mating surface 204 on the other end allowing access to a hollow interior area 205 of the casing. Incorporated on one side of cylindrical body 202 of casing is an arm 206 extending past mating surface 204 as shown. Arm 206 has an array of teeth 207 arranged along its length and is tapered at its leading end. Incorporated on the opposing side of body 202 from arm 206 is a rectangular latch frame 208. A latch opening 209 is incorporated in latch frame 208 into which a latch assembly 210 is installed. Casing element 201*a* has a slot opening 214 that runs parallel to a centerline of casing 201*b* from mating surface 204 to distal end surface 203 and then across the distal end surface to its center point. FIG. 2*a* shows an engaged connection 221 consisting of a male connector 215 mated to a female connector 216 and an electrical cord 217 which may be cradled in slotted openings 214 in casings 201*a* and 201*b*. Dimension F indicates the narrowest cross-sectional dimension of engaged connection 221.

Figure 2B:
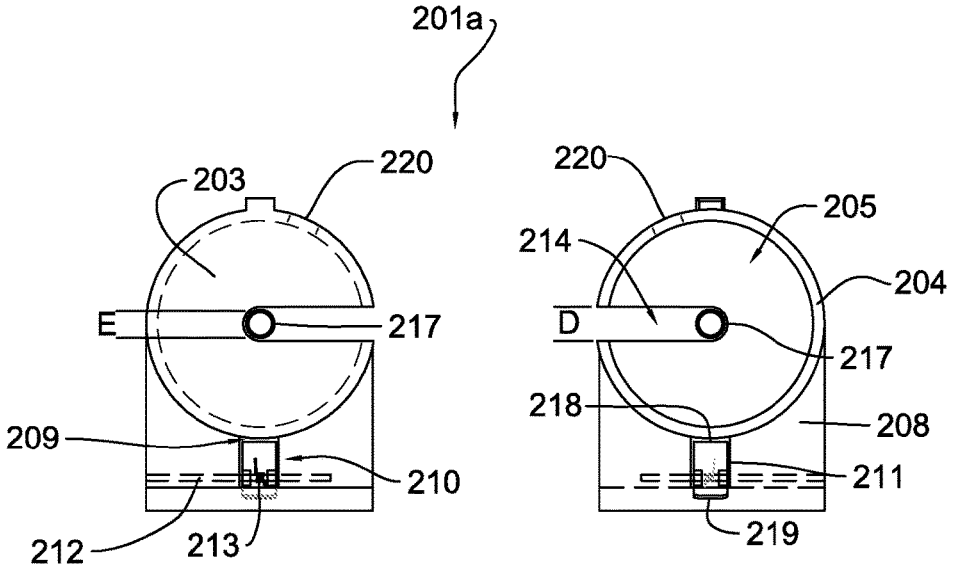
FIG. 2*b* depicts end views of one of the identical casings.

FIG. 2*b* provides end views of casing 201*a*. This figure provides end views from distal closed end 203 and open mating surface 204, and the hollow area 205 inside casing 201*a*. Latch assembly 210 consists of a latch 211 which is affixed to and rotates about a latch hinge pin 212 installed in latch frame 208 and a latch spring 213. Latch 211 has two ends, a latch engaging end 218 and a latch release end 219. Latch spring 213 is installed on latch hinge pin 212 between latch frame 208 and engaging end 218 of latch 211. In this position spring 213 holds engaging end 218 in a semi-closed position against body 202 of casing 201*a*.

Figure 2C:
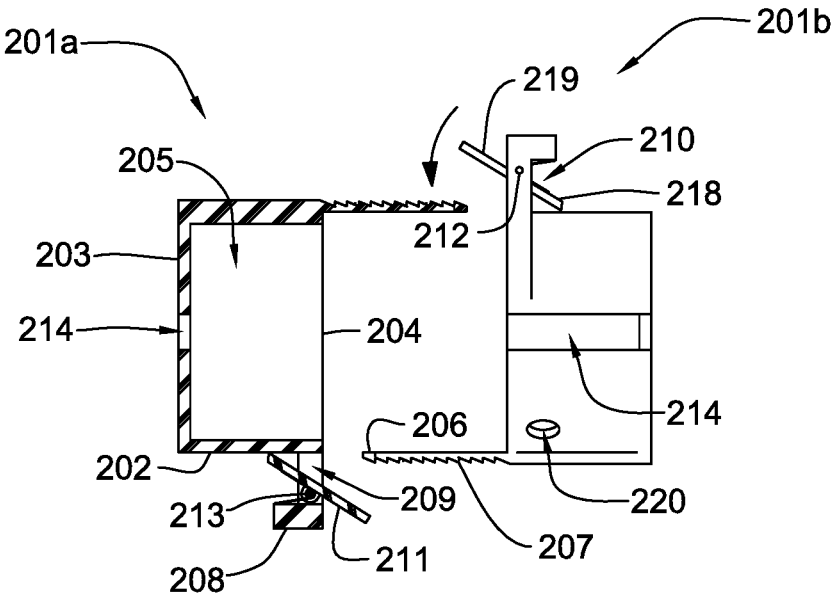
FIG. 2*c* provides a section view and a front elevation view of the casings.

FIG. 2*c* provides a cross section of casing element 201*a* and a front elevation view of identical casing element 201*b*. This figure more clearly illustrates how the identical casings 201*a* and 201*b* align. The arrow shows the direction of rotation to operate latch release 219.

Referring back to FIG. 2*b* electrical cords 217 are cradled in slotted openings 214 parallel to the centerline as shown in these end views. A dimension D indicates width of slotted opening 214 and diameter of the semicircular end and a dimension E indicates diameter of a typical cord. Dimension D is greater than dimension E but is smaller than dimension F. The width of slot opening 214 allows a cord 217 of lesser diameter to slide into place, but the opening is narrow enough that the larger width of the engaged connection 221 will keep the connection safely constrained inside the mated casings.

Hollow area 205 inside the conjoined casings may be of any size that can accommodate engaged connection 221, for example it may be 1½ inches or greater in diameter, and 2 inches to 6 inches deep. The overall length of the conjoined casings is adjustable to accommodate various lengths of connectors depending on the number of the teeth 207 and length of arms 206.

Casings 201*a* and 201*b*, arms 206, latch frames 208, and latches 211 may be constructed of any sturdy moldable material, for example polymers including durable UV-resistant plastic with some flexibility to reduce potential for breakage. Latch hinge pin 212 and latch spring 213 may be constructed of metal, plastic, metalloid, or any other suitable material.

FIG. 2*a* illustrates that to use this device, connectors 215 and 216 are engaged and electrical cords 217 are cradled in slotted openings 214 in casings 201*a* and 201*b* parallel the centerline as shown. The user moves casings 201*a* and 201*b* linearly together as indicated by the directional arrows in FIG. 2*a*.

FIG. 2*c* illustrates how the user aligns casing elements 201*a* and 201*b* together linearly so that tapered arms 206 on each casing can be inserted into matching latch openings 209 in latch frames 208. As the user continues to move the casing elements linearly together, each arm 206 advances through latch opening 209, forcing the spring loaded latch engaging end 218 to retract slightly to accommodate advancing teeth 207.

Latch engaging end 218 is then forced by latch spring 213 to close behind each advancing tooth 207. As engaging ends 218 close behind teeth 207, elements 201*a* and 201*b* cannot be separated unless the user depresses both latch releases 219 simultaneously in the direction of rotation indicated by the arrow in this figure. Pressing latch releases 219 causes latches 211 to rotate about latch hinge pins 212 which retract the opposing engaging ends 218 from behind the teeth 207 on arms 206. The back side of each tooth 207 is canted slightly away from perpendicular to arm 206 to allow for smooth rotation and release of the latch engaging end 218 from the tooth.

Figure 2D:
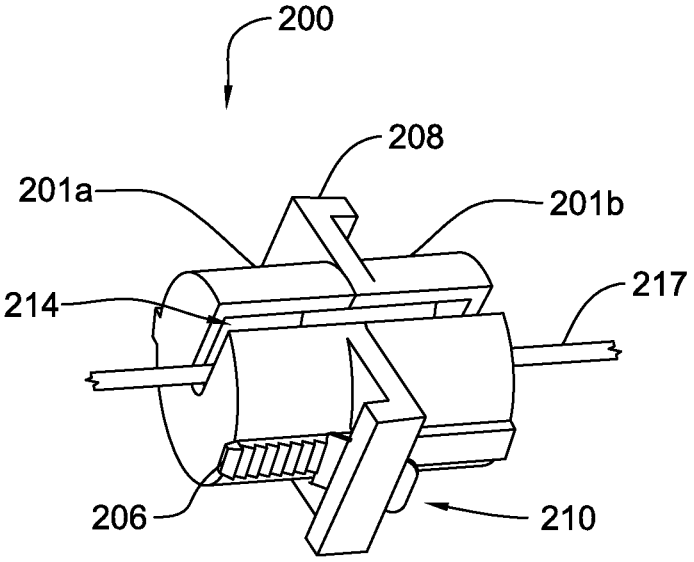
FIG. 2*d* is a perspective view of the two casings encompassing and securing the engaged cord connection.

FIG. 2*d* depicts casings 201*a* and 201*b* in a closed and secured position. The user continues to slide casings 201*a* and 201*b* toward each other until the inside surfaces of hollow distal ends 203 (not shown) of casings are both in contact with engaged connection 221 or until mating surfaces 204 (not shown) come in contact with each other. Engaged connection 216 (not shown) is held securely together and protected from unintentional disconnection via latch assemblies 210.

Referring back to FIG. 2*c*, when the cord securement device is no longer required, the user will depress latch releases 219 simultaneously and slide casings 201*a* and 201*b* away from each other until teeth 207 on arms 206 are no longer held by latch engaging ends 218 and casings are no longer conjoined. Cord connectors 215 and 216 can then be disengaged. When no longer in use, casings 201*a* and 201*b* may be slid together as described herein, securing them together over one of the extension cord connector ends for convenient storage and safe keeping. As an alternative, a tether hole 220 is included in each of the two casings to allow them to be attached with a tethering device (not shown).

Figure 3A:
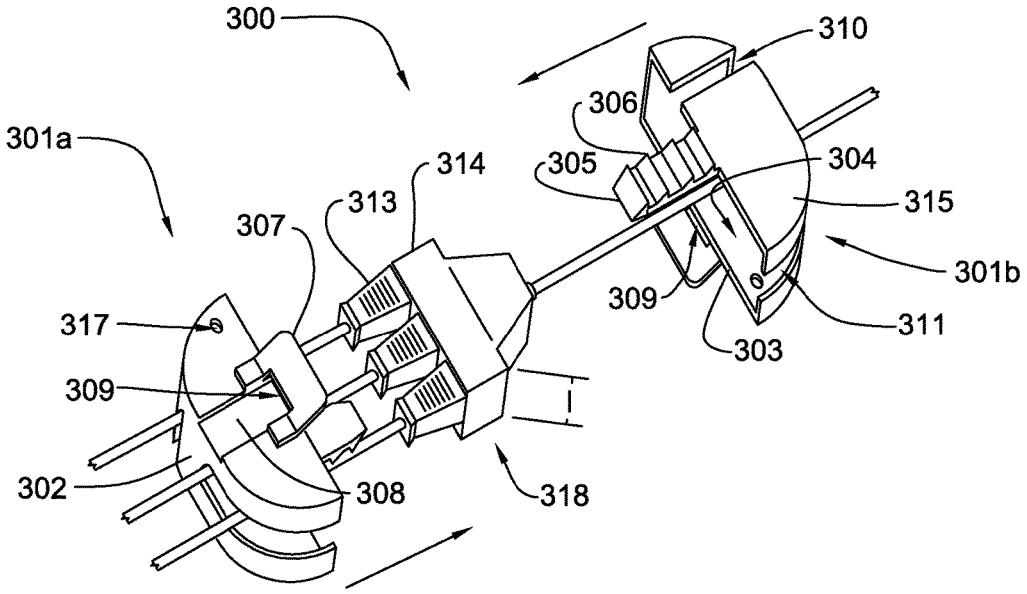
FIG. 3*a* is a perspective view of a multi-cord embodiment of the device.

FIG. 3*a* depicts another embodiment of an electrical cord securement system. Securement device 300 is composed of two identical casing elements 301*a* and 301*b*. Casing 301*a* has a hollow cubic body with rounded ends and has a closed surface at the distal end 302 and an open mating surface 303 allowing access to a hollow interior 304 of the casing. Incorporated on a flat side 315 of casing 301*a* is an arm 305 which extends past mating surface 303. Arm 305 has an array of teeth 306 arranged along its length and the arm is tapered at the leading end. On the opposing flat side 315 from arm 305 is a C-shaped clip 307 and a depressed channel 308. C-clip 307 may be molded as an integral part of and of the same material as casing 301*a* as shown, or created of another material and affixed separately to the casing. C-clip 307 includes two ends that are configured to attach to flat side 315 of the casing. Near the mating surface 303 C-clip 307 bends slightly away from a centerline of the device. C-clip 307 and depressed channel 308 together create an opening 309 which can easily receive the tapered end of arm 305. Opening 309 receives arm 305 such that it is adjacent to casing 301*a* along channel 308. C-clips 307 shall be flexible enough to allow them to retract as teeth 306 on arms 305 are inserted through opening 309 and to release clip 307 from the teeth and disengage casings 301*a* and 301*b* from each other. FIG. 3*a* shows an engaged connection 318 consisting of one (or more) male connector(s) 313 mated to a female connector 314 and electrical cords 312 which may be cradled in slotted openings 310 and 311. A dimension I indicates the narrowest cross-sectional dimension of the engaged connection 318. Casing element 301*b* is identical to element 301*a* having all of the same elements and identification numbers.

Figure 3B:
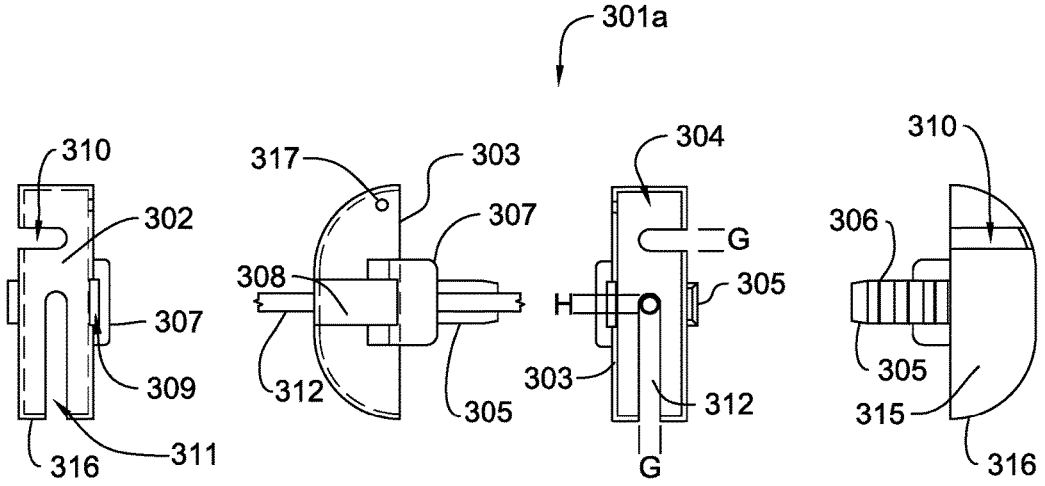
FIG. 3*b* provides side views of four sides of the identical casing elements.

FIG. 3*b* provides views of four sides of casing 301*a*. This figure shows a single-cord slot opening 310 that runs parallel to but offset from the centerline on one flat side 315 of casing 301*a* from the meeting surface 303 and to the distal end 302 and then to the center of the distal end. FIG. 3*b* also shows that each casing also has a multiple-cord slot opening 311 which runs along a longitudinal center line originating at short side 316. Multi-cord slot opening 311 ends in a semicircular configuration centered at surface 302.

Figure 3C:
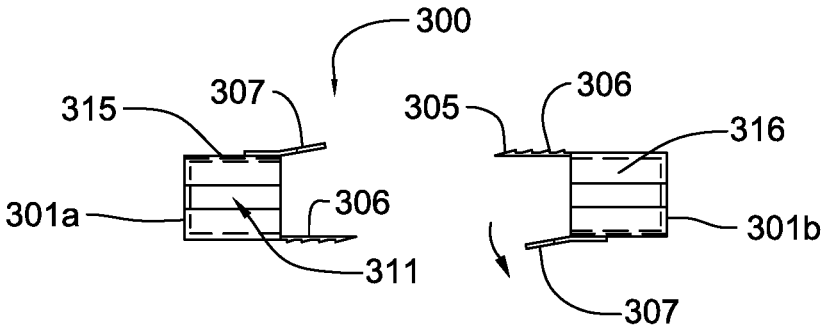
FIG. 3*c* provides an end view of the two casings.

FIG. 3*c* provides an end view of the electrical cord securement system 300 as depicted in FIG. 3*a*. The end view shows continuation of slot 311 along one side. This figure shows a relative alignment of arms 305 and corresponding C-clips 307 on casings 301*a* and 301*b*. C-clips 307 as shown are at rest, but may be lifted away from the casings in the direction indicated by the rotational arrow.

In FIG. 3*b* electrical cord 312 is indicated in slotted opening 311 in the two center views of casing 301*a*. A dimension G indicates the width of slotted opening 310 and 311 and diameter of the semi-circular ends of the openings. Width G of slots 310 and 311 are equal. A dimension H represents the diameter of a typical cord 312. Width G is greater than dimension H. The greater widths G of slot openings 310 and 311 allow cords 312 to slide into casings 301*a* and 301*b*, but the openings are narrower than dimension I indicated in FIG. 3*a* of engaged connection 318 such that the connection will be safely constrained within the conjoined casing. It is understood that dimensions for slots 310 and 311, and cords 312 are identical between casings 301*a* and 301*b*. Hollow area 304 inside the conjoined casings may be of any size that can accommodate engaged male and female connectors, for example it may be 1½ inches or greater along short side 316 of casing, 5 inches or greater along the width of flat side 315 of casing, and 4 inches to 6 inches deep to accommodate a multiple plug connector engaged to individual connectors or multiple individual pairs of connectors. The overall length of the conjoined casings is adjustable to accommodate various lengths of connectors depending on the number of teeth 306 and length of arm 305 that are engaged by C-clip 307.

Casings and attached elements may be constructed of any sturdy moldable material, for example polymers including durable UV-resistant plastic with some flexibility to reduce potential for breakage.

FIG. 3*a* illustrates closing and securing casings 301*a* and 301*b* about an engaged connection 318. In this embodiment, one or more male connector(s) 313 are engaged to a female multi-receptacle connector 314 and electrical cords 312 are slipped into openings 310 and 311 as shown such that they are parallel to the centerline. The user moves casing elements 301*a* and 301*b* linearly along cords 312 as indicated by the directional arrows in this figure until tabs 305 on one casing are aligned with matching C-clip openings 309 on the other casing. As the user continues to move casing elements together each arm 305 advances through C-clip opening 309. C-clips 307 are forced to flex slightly away from the casing to accommodate advancing teeth 306. As teeth 306 advance past C-clip opening 309, the clip relaxes to its original position effectively closing behind teeth 306 and preventing movement of arm 305 in an opposite direction.

FIG. 3*c* shows the direction the user lifts clip 307 away from the casing to unclip it from teeth 306 as indicated by the rotational arrow. As C-clips 307 rest behind teeth 306 casing elements 310*a* and 301*b* cannot be separated unless the user lifts both C-clips simultaneously. When both clips 307 are lifted far enough in direction indicated to clear withdrawing teeth 306, arms 305 can be withdrawn through C-clip openings 309. The back side of each tooth 306 is shaped so its surface is canted slightly away from perpendicular to allow for the smooth outward lifting of C-clip 307 releasing it from behind the tooth.

Figure 3D:
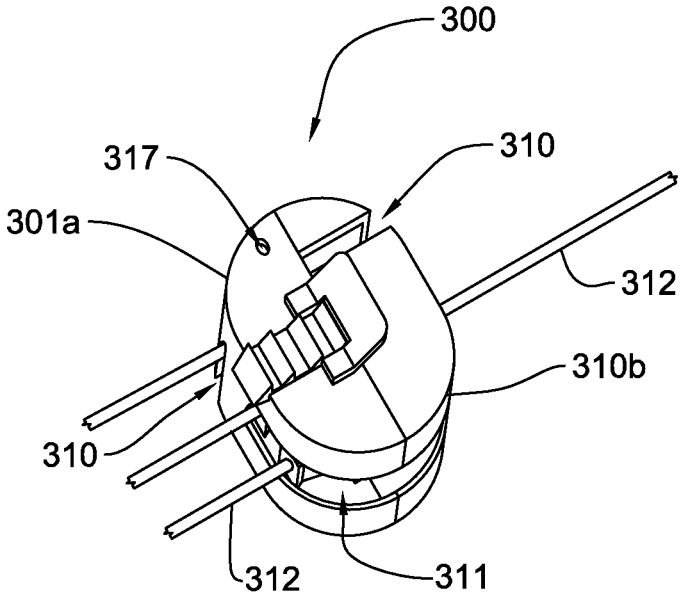
FIG. 3*d* is a perspective view of two identical casings encompassing and securing the engaged cord plug connections.

FIG. 3*d* illustrates that as the user continues to slide casings 301*a* and 301*b* toward each other until hollow distal ends 302 are both in contact with the engaged connection 318 within which is then held securely together and protected from unintentional disconnection.

When the cord securement device is no longer required, the user lifts C-clip 307 and slides casings 301*a* and 301*b* linearly away from each other as described herein until casings 301*a* and 301*b* are no longer conjoined. Electrical connectors 313 and 314 may then be disengaged. When no longer in use casings 301*a* and 301*b* may be slid together over one of the extension cord connectors securing them for convenient storage and safe keeping. As an alternative, a tether hole 317 is included in each of the casings to allow them to be attached with a tethering device (not shown).

It will be apparent to one with skill in the art that there may be variant architectures and hardware additions that may be provided to the base electrical cord securement assembly without departing from the spirit and scope of the present invention, such as a flexible cord to tether two casings together when not in use.

It will be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented within the scope of the invention. The invention is limited only by the breadth of the claims below.

The invention claimed is:

1. A system for securing an electrical connection, comprising;

a first cylindrical hollow body, having a diameter, a closed end and an open end, the open end including an edge forming a first circumference;

a second cylindrical hollow body, having a closed end and an open end, the open end including an edge forming a second circumference;

a second latch frame extending orthogonally from the edge of the second cylindrical body;

wherein the closed ends of the first and second cylindrical body each include a cord opening allowing at least one cord to pass through the opening while holding at least one first electrical connector within the first cylindrical hollow body and at least one second electrical connector within the second cylindrical hollow body, and with the connectors engaged, the open ends extend to completely surround the first and second connector respectively and the first and second circumference are aligned and face each other, the latch frames include a width equal to the diameter, and the first and second cylindrical hollow bodies include a means for securely attaching to each other thereby preventing disconnection of the engaged connectors.

2. The system of claim 1, wherein the means for securely attaching includes at least one tooth on an extension arm extending away from the open end of the first cylindrical hollow body and towards the open end of the second cylindrical hollow body, the arm extending through an arm opening formed in the second latch frame making contact with a tab on the second latch frame positioned to engage the at least one tooth.

3. The system of claim 2, wherein multiple teeth are positioned in a linear array on the arm, thereby enabling the tab to engage any one of the teeth thereby manipulating distance between the first cylindrical body and the second cylindrical body thereby accommodating connectors of varying sizes.

4. The system of claim 3, wherein the second cylindrical body includes a second arm, having at least one tooth, extending away from the open end of the second cylindrical hollow body and towards the open end of the first cylindrical hollow body, the second arm extending through an arm opening formed in a first latch frame extending orthogonally from the edge of the first cylindrical body, making contact with a tab on the first latch frame positioned to engage the at least one tooth of the second arm.

5. The system of claim 4, wherein the first and the second cylindrical hollow bodies are identical and the first and second arms and first and second latch frames are placed on opposing positions of each cylindrical hollow body thereby equalizing any force urging the connectors apart when the tabs are engaged with one of the multiple teeth.

6. The system of claim 1, wherein the first and the second cylindrical hollow bodies are identical.

7. The system of claim 1, wherein the cord opening of the first and second cylindrical bodies include a slot connecting the open end and the cord opening, the cord opening and the slot having a diameter less than a width of the connectors.

8. A method for securing electrical connectors comprising the steps of:

(a) providing a first cylindrical hollow body including a closed cord end and an open end having an edge forming a first circumference, an arm opening in one position on a first latch frame extending orthogonally from the edge of the open end, the latch frame having a width equal to a diameter of the first cylindrical hollow body;

(b) providing a second cylindrical hollow body including a closed cord end, an open end having an edge forming a second circumference, and an arm extending away from the open end, the arm including at least one tooth;

(c) holding at least one first electrical connector attached to a cord within the first cylindrical hollow body and holding at least one second electrical connector attached to a cord within the second cylindrical hollow body, the cords extending away from the first and second cylindrical connectors through the cord openings;

(d) with the first and second circumferences aligned and facing each other, and the connectors engaged, inserting the arm with the at least one tooth on the first half through the arm opening on the first latch frame and a tab positioned above the arm opening engages the tooth preventing the arm from withdrawing out of the arm opening; and (e) manipulating the tab thereby releasing the at least one tooth removing the arm from the arm opening and disengaging the connectors.

9. The method of claim 8, wherein multiple teeth are positioned in a linear array on the arm, thereby manipulating distance between the first and second cylindrical hollow bodies and accommodating connectors of varying sizes.

10. The method of claim 8, wherein the first cylindrical body includes a second arm, having at least one tooth, extending away from the open end of the first cylindrical hollow body and towards the open end of the second cylindrical hollow body, the second arm extending through an arm opening formed in a second latch frame making contact with a tab on the second latch frame positioned to engage the at least one tooth of the second arm, the second latch frame having a width equal to a diameter of the second cylindrical hollow body.

11. The method of claim 10, wherein the first and the second cylindrical hollow bodies are identical and the first and second arms and first and second latch frames are placed on opposing positions of each cylindrical hollow body thereby equalizing any force urging the connectors apart when the tabs are engaged with one of the multiple teeth.

* * * * *